United States Patent [19]

Küpper

[11] 4,398,681

[45] Aug. 16, 1983

[54] THREAD BRAKE FOR CREELS

[75] Inventor: Wilhelm Küpper, Wegberg, Fed. Rep. of Germany

[73] Assignee: W. Schlafhorst & Co., Monchen-Gladbach, Fed. Rep. of Germany

[21] Appl. No.: 364,876

[22] Filed: Apr. 2, 1982

[30] Foreign Application Priority Data

Apr. 6, 1981 [DE] Fed. Rep. of Germany ..... 3113829

[51] Int. Cl.[3] ..... B65H 59/24; B65H 77/00

[52] U.S. Cl. ..... 242/150 R; 188/65.2

[58] Field of Search ..... 242/150 R, 149, 131, 242/131.1; 188/65.2, 72.9, 77 W; 220/195

[56] References Cited

U.S. PATENT DOCUMENTS

| | | | |
|---|---|---|---|
| 2,478,926 | 8/1949 | Kingsbury | 242/150 M X |
| 2,907,535 | 10/1954 | Mindheim | 242/150 M |
| 3,297,264 | 1/1967 | Gilbos | 242/150 X |
| 3,709,332 | 1/1973 | Rosen | 242/150 M X |
| 4,133,492 | 1/1979 | Derichs | 242/150 R |
| 4,202,511 | 5/1980 | Koslowski | 242/150 R |
| 4,272,308 | 6/1981 | Wildi | 242/150 R |

*Primary Examiner*—Stuart S. Levy
*Assistant Examiner*—Dao Huynh
*Attorney, Agent, or Firm*—Herbert L. Lerner; Laurence A. Greenberg

[57] ABSTRACT

Thread brake for creels having at least one pair of braking discs with a central rotary drive and at least one separate rope friction body, including an adjustable loading device having a loading element, a common holding device for the rope friction body and for the adjustable loading device, the rotary drive having a central vertical shaft holding the pair of braking discs including an upper braking disc comprising a braking disc member and a disc holder secured thereto, the disc holder being formed of plastic material and connected to the shaft so as to be fixed against rotation relative thereto and a lower braking disc resting on the loading element of the loading device.

20 Claims, 5 Drawing Figures

THREAD BRAKE FOR CREELS

The invention relates to a thread brake for creels and, more particularly, to such a thread brake having at least one pair of braking discs with a central rotary drive and at least one separate rope friction body. Such thread brakes are used, for example, if the thread is to be deflected from the original direction thereof to another direction and is to be subjected to tension at the same time. The thread is guided successively through a pair of braking discs and over a rope friction member. The pair of brake discs is thereby representative of a normal friction brake in which the normal force acting on the thread is independent of the magnitude of the thread tension forward of the brake i.e. upstream thereof in travel direction of the thread. The rope friction body represents a rope friction brake in which the normal force acting on the thread is independent of the magnitude of the tension as well as of the magnitude of the looping angle. Several brake disc pairs and several rope friction members may also be united into a combined thread brake.

A thread brake of this type ensures reliable thread guidance, avoids rotational backup of the thread and has good self-cleaning action. After a thread break, reinsertion of the thread can be accomplished easily.

Such thread brakes, however, are of complicated design and require major disassembly work if a thread and reassembled for the purpose of inspection or cleaning thereof. The central rotary drive is complex and trouble-prone.

All of the thread brakes and the holders and fastening elements thereof, respectively, which are driven by the same shaft, must be aligned very exactly. Since this is practically impossible, increased and non-uniform friction occurs at the bearing points of the rotary drives.

It is accordingly an object of the invention to provide an improved thread brake for creels which ensures a trouble-free, low-friction parallel run of a plurality of jointly or commonly driven thread brakes while the thread brake is largely encapsulated; provides a central drive which is readily accessible; and ensures that the thread brake as a whole and the individual parts thereof are easy to assemble.

Advantages derived from the invention are, in particular, that, due to the holding or supporting of the pair of braking discs at the vertical shaft of the rotary drive, detrimental canting of the pair of braking disc and the disc holders thereof, respectively, relative to the shaft of the rotary drive is no longer possible. This bearing support, which is independent of the holding device of the thread brake, ensures automatic centering of the pairs of braking discs of several thread brakes disposed above one another, independently of the respective position and alignment of the holding devices which are common to the rope friction members and the loading device. Other advantages are also contemplated, for example, the advantage of letting the lower braking disc member rest on a support element of an adjustable loading device, so that the braking force of the braking disc pair can be determined.

With the foregoing and other objects in view, there is provided, in accordance with the invention, a thread brake for creels having at least one pair of braking discs with a central rotary drive and at least one separate rope friction body including an adjustable loading device having a loading element, a common holding device for the rope friction body and the adjustable loading device, the rotary drive having a central vertical shaft holding the pair of braking discs including an upper braking disc comprising a braking disc member and a disc holder secured thereto, the disc holder being formed of plastic material and connected to the shaft so as to be fixed against rotation relative thereto and a lower braking disc resting on the loading element of the loading device.

Protection against dust and dirt accumulation in the pair of braking discs, and, simultaneously, a threading aid for the thread are provided in accordance with another feature of the invention, wherein the disc holder of the upper braking disc member is in the form of a hood which has a smooth outer surface and extends over the rim of the braking disc.

Protection against axial displacement of the upper braking disc member is accomplished, in accordance with a further feature of the invention, by the shaft of the rotary driver itself or by providing that the holding device have a vertical mounting plate (for fastening to a creel beam or the like), to which a yoke is fastened, against which the disc holder of the upper braking disc member engages from below. Such a yoke, for example, has an opening or a slot for the shaft to pass therethrough. The yoke serves simultaneously as a thrust bearing for the upper braking disc member and thus relieves the load on the shaft so that the shaft itself does not require a thrust bearing to take up axial forces.

In accordance with an added feature of the invention, the loading device is constructed so that a bearing point is provided at the holding device at which one end of a lever-like loading element of the loading device is supported, whereas the other end of the loading element is in contact with a pneumatic pressure device, and the loading element has a cutout for the shaft to pass therethrough and is in contact, in vicinity of the cutout, with the lower braking disc member of the disc holder thereof. The contact location may be either knife-edge-like or circular. The support element, in accordance with the invention, has a preloading device which includes a coil or helical spring and a setscrew for changing pretensioning of the spring.

In a further embodiment of the invention, the pneumatic pressure device comprises a thin-walled expansion body which is acted upon by compressed gas. More particularly, in accordance with the invention, the expansion body is a small rubber bubble or rubber lens or is a bellows-shaped diaphragm or membrane or rubber-elastic material.

Since several thread brakes are disposed above one another and are driven in common or jointly, an additional feature of the invention is that the shaft is constructed as a drive shaft extending through the pairs of braking discs of several thread brakes disposed above one another for holding and driving them, and is partially supported outside the thread brakes in separate shaft bearings.

In accordance with an alternative feature of the invention, the shaft is a hollow shaft and is supported in a separate hollow-shaft bearing without having to extend simultaneously through several pairs of braking discs. More particularly, according to the invention, the hollow shaft is surrounded, at the level of the pair of braking discs, by a sleeve of wear-resistant material. The sleeve may serve as wear protection for the hollow shaft and, simultaneously, as a rope friction body for the thread.

Since the expansion body of the loading device must be kept below the pair of braking discs, in accordance with a further embodiment of the invention, the hollow-shaft bearing and the expansion body of the loading device have a common support.

In yet another embodiment of the invention, a common rotatable drive shaft or drive rod extend through the hollow shafts of several thread brakes disposed above one another, and is connected to the hollow shafts so as to be secured against relative rotation therewith. Since each hollow shaft is supported in the bearings by itself, each hollow shaft simultaneously forms a guide for the drive shaft or drive rod. Thus, it is sufficient to provide a connection secured against relative rotation by profiling the parts placed inside each other or by some other method, without employing a close or tight fit. The drive shaft or the drive rod should have sufficient freedom of movement laterally in the hollow shafts. Since the drive shaft or drive rod revolves relatively slowly, precision constructions are not necessary therefor. Also the bearing support of the drive shaft or drive rod may be quite simple; it is even possible to dispense with separate bearings, since good lateral guidance is provided, and the drive shaft or drive rod can be suspended at the top from a transmission or other driving device. The disc holder of the upper braking disc member is held in this case by the hollow shaft and not by the drive shaft or drive rod.

However, it is also possible to lock the disc holder of the upper braking disc member directly at the drive shaft or drive rod. In this case, the drive shaft or drive rod must be capable, however, of supporting all upper braking disc members of a creel beam and the disc holders thereof, and of taking up the forces produced by the loading devices. In this connection there is proposed, in accordance with a further embodiment of the invention, to provide the disc holder of the upper brake disc with a central sleeve, and include a pressure ring inserted between the shaft, the hollow shaft and the drive shaft or drive rod and the sleeve.

The pressure ring then establishes the connection between the disc holder and the rotating part.

According to another embodiment of the invention, the shaft bearing is formed of a sleeve which extends from below into the pair of braking discs and is surrounded at the level of the pair of braking discs by a sleeve of wear-resistant material. Thus, this sleeve does not rotate, just as the second sleeve consisting of wear-resistant material which serves as wear protection. Such a sleeve-like shaft bearing when the loading device is switched off, can absorb simultaneously the weight of the upper brake disc and the disc holder thereof. In this embodiment according to the invention, the expansion body of the loading device and the shaft bearing have a common support.

A particularly space-saving alternative type of fasteneing of the thread brake to the creel beam in accordance with the invention includes a thread brake wherein a holding device is fastened to a beam of a creel, the creel beam being L-shaped and having two mutually perpendicular support legs, both engaged by the holding device.

In accordance with yet another feature of this alternative fastening means, the creel beam is formed of angled-off sheet metal having lateral edges which are flanged-over outwardly.

In accordance with a concomitant feature of the alternative fastening means, a clamp is connected to the holding device of the creel beam, the clamp being secured to the holding device and extending beyond one of the lateral edges of the sheet metal creel beam.

The holding devices of several thread brakes, disposed above one another, have a stabilizing effect simultaneously upon the creel beam which can therefore be provided with a light-weight construction.

Other features which are considered as characteristic for the invention are set forth in the appended claims.

Although the invention is illustrated and described herein as embodied in thread brake for creels, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiment when read in connection with the accompanying drawings, in which.

Figure 1:
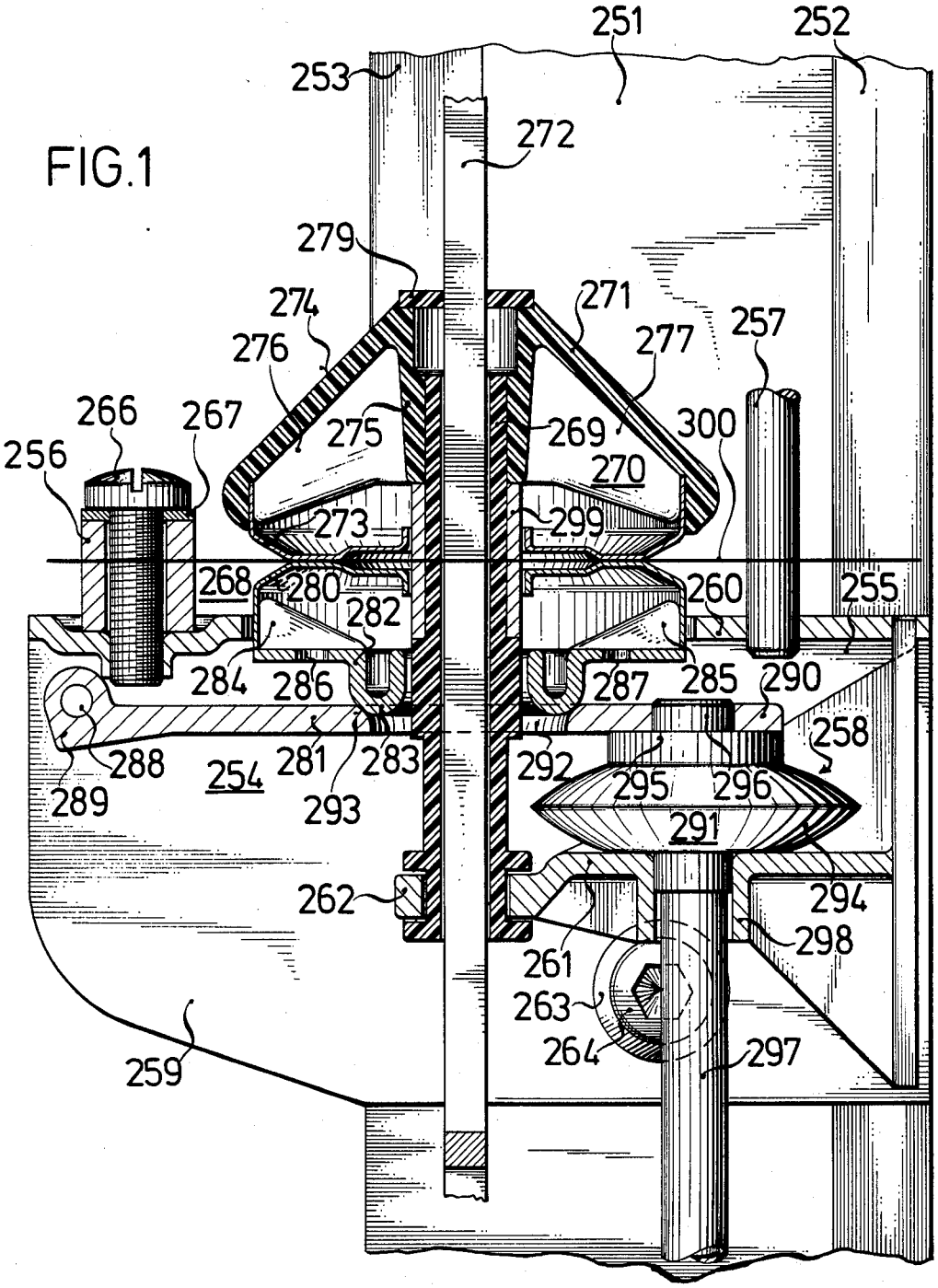
FIG. 1 is a longitudinal sectional view of a first embodiment of the thread brake for creels according to the invention.
Figure 2:
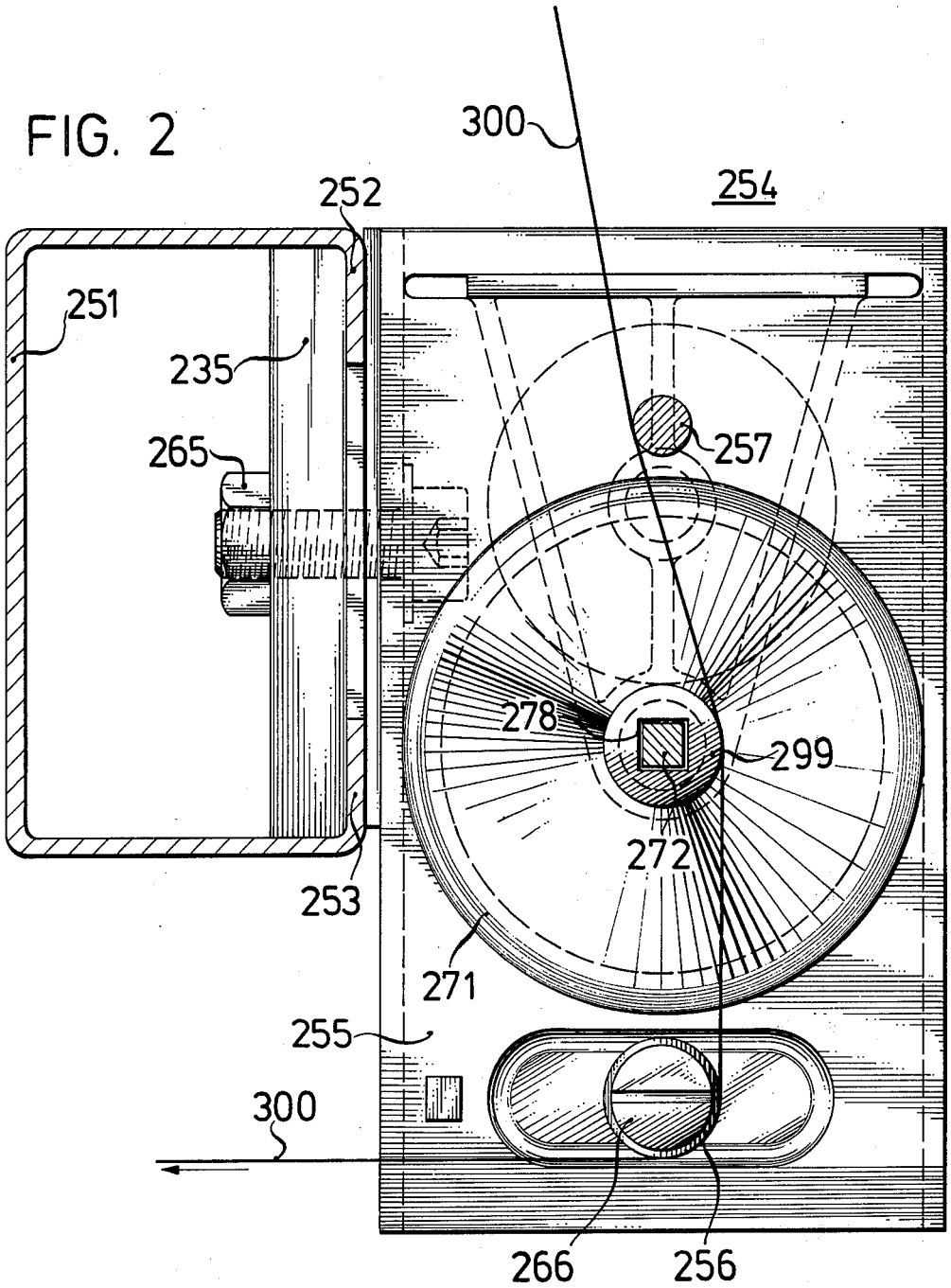
FIG. 2 is a top plan view of FIG. 1 rotated through 90° counterclockwise.

Referring now to the drawing and first, particularly to FIGS. 1 and 2 thereof, there is shown a first embodiment of a thread brake for creels according to the invention. No creel per se is illustrated in its entirety in the figures, but only a single vertical creel support beam 251 thereof is shown. The creel beam 251 has a C-shaped profile. Beam strips 252, 253 provided at the open profile side are directed towards the thread brake which is identified as a whole by reference numeral 254.

The thread brake 254 has a common holding device 255 for rope friction members 256, 257 and for an adjustable pneumatic loading device 258. The holding device 255 is formed of a rear wall 259, a support plate 260 with a cutout for the two rope friction members 256, 257 and a common support beam 261 for a hollow-shaft bearing 262 and for a loading device 258.

The holding device 255 is connected to the creel beam 251 by a screw connection formed of a bridge 235 inserted into the creel beam 251, a washer 263, a screw 264 and a nut 265.

The rope friction member 256 is formed of a sleeve of wear-resistant material which is fastened to the support plate 260 by a screw connection consisting of a screw 266 and a washer 267. The thread brake 254 furthermore has a brake disc pair identified as a whole by reference numeral 268.

The pair of brake discs 268 is not carried or held by the holding device 255, but by a hollow shaft 269 of a rotary drive identified as a whole by reference numeral 270. Besides the hollow shaft 269, a disc holder 271 and a drive rod 272 belong to the rotary drive 270. The disc holder 271 of the upper brake disc 273 of the pair of brake discs 268 is in the form of a hood which has a smooth outer surface 274 and extends over the rim of the brake disc 273. The disc holder 271 is formed of injection-molded plastic material and is connected to the hollow shaft 269, secured against rotation relative thereto and more specifically by the provision that the disc holder 271 has a central sleeve 275 which is pressed onto the hollow shaft 269. The disc holder 271 is stiffened by webs 276, 277. FIG. 2 shows that the vertical drive rod 272 has a square cross section, as is likewise the case for the central opening 278 of the holow shaft 269. A cover 279 formed of plastic material prevents dust from penetrating into the rotary drive 270.

The drive rod 272 extends upwardly and downwardly along the creel beam 251, passing through several identical thread brakes 254 arranged above one another, and ending at the top in a non-illustrated transmission which imparts a slow rotation to the drive rod 272.

The lower brake disc 280, likewise, has a disc holder 282 provided with a circular bead 283 which rests on a loading element 281 of the loading device 258. The disc holder 282 has webs 284, 285 which serve as stops for the rim of the lower brake disc 280.

Furthermore, the disc holder 282 is formed with openings 286, 287 through which abraded fiber particles and dust can be discharged.

The holding device 255 has, at the rear wall 259 thereof, a support point 288 in the form of a pin at which one end 289 of the lever-like loading element 281 of the loading device 258 is supported, the end 289 being formed as a bearing eye. The other end 290 of the loading element 281 is in contact with a pneumatic pressure device 291. The loading element 281 is formed with a cutout 292 for the passage therethrough of the hollow shaft 269. At the rounded edge 293 defining the cutout 292, the loading element 281 is in contact with the circular bead 283 and, therefore, with the disc holder 282 of the lower brake disc 280.

The pneumatic pressure device 291 has a thin-walled expansion body 294 which is acted upon by compressed gas and is formed of a bellows-shaped diaphragm or membrane of rubber-elastic material. On the expansion body 294, there lies a disc 295 carrying a post or pin 296 which is inserted into an opening provided at the end 290 of the loading element 281. A flexible tube or hose 297 is connected to the expansion body 294 and extends downwardly through a connecting stub 298 machined into the beam 261. The bore 297 is detachably connected to a non-illustrated compressed-gas line which is extended along the creel beam 251. The gas pressure prevailing in the compressed-gas line can be adjusted centrally. It is then effective in all thread brakes of the same creel beam. Air is preferably used as the compressed gas.

At the level of the brake disc pair 268, the hollow shaft 269 is surrounded by a sleeve 299 of wear-resistant material. The sleeve 299 is pressed onto the hollow shaft 269 and serves as a rotating rope friction body for the thread 300 as is shown in FIG. 2.

The position of the upper brake disc 273 is fixed by the hollow shaft 269 and the position thereof. The lower brake disc 280 obtains its lateral guidance likewise from the hollow shaft 269. The movement of the lower brake disc 280 up and down is limited by the loading device 258, which exerts a force on the lower brake disc 280 by means of the loading element 281. An effect of the lever transmission ratio is that the pneumatic device can operate with only slight overpressure. This makes the entire creel operation more reliable. Cleaning work is very easily performed, it being necessary only to pull the disc holder 271 off the hollow shaft 269 upwardly. In replacing the disc holder 271 on the hollow shaft, no setting mark need to be observed because the sleeve 299 serves as a stop for the central sleeve 275 of the disc holder 271. The upper brake disc 273 automatically assumes its prescribed position if the disc holder 271 thereof is pushed up to the stop by hand. Tools are not required for this.

Figure 5:
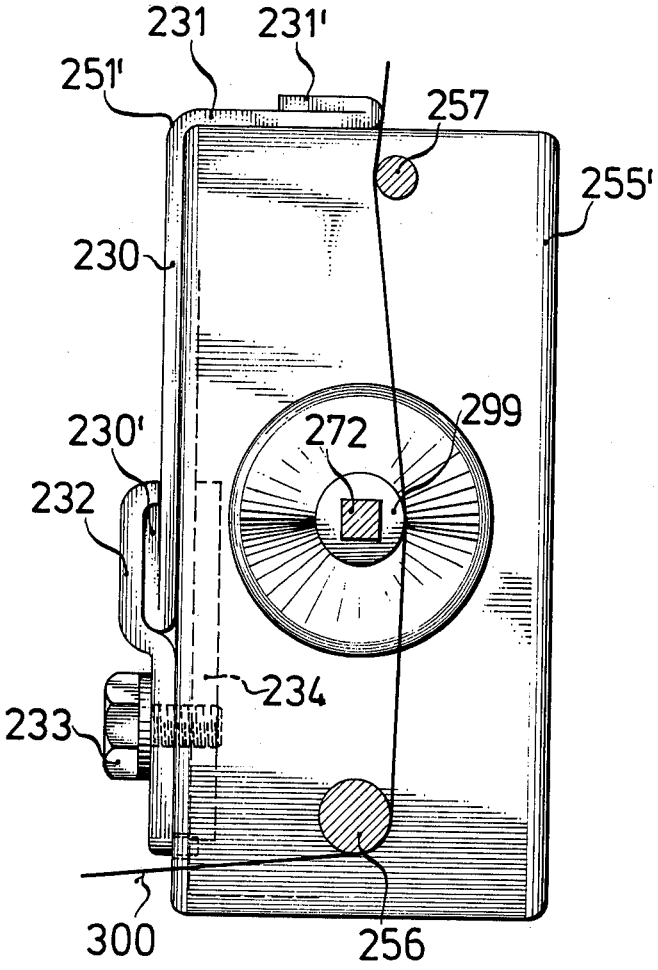
FIG. 5 is a view similar to that of FIG. 2 showing an alternative construction for fastening the thread brake.

An alternative construction of the thread brake fastening means is shown in FIG. 5. The holding device 255' is fastened with efficient space utilization to an L-shaped creel beam 251' by means of a clamp 232 and a screw 233. The clamp 232 surrounds one of the two flanged-over lateral edges 230', 231' of the creel beam 251' and, more specifically, the lateral edge of the beam leg 230.

The other beam leg 231 rests flush against the holding device 255'.

The screw 233 engages in a thread formed in a bridge 234, by which the thin wall of the holding device 255' is braced. The lateral edges serve simultaneously for guiding the thread.

Figure 3:
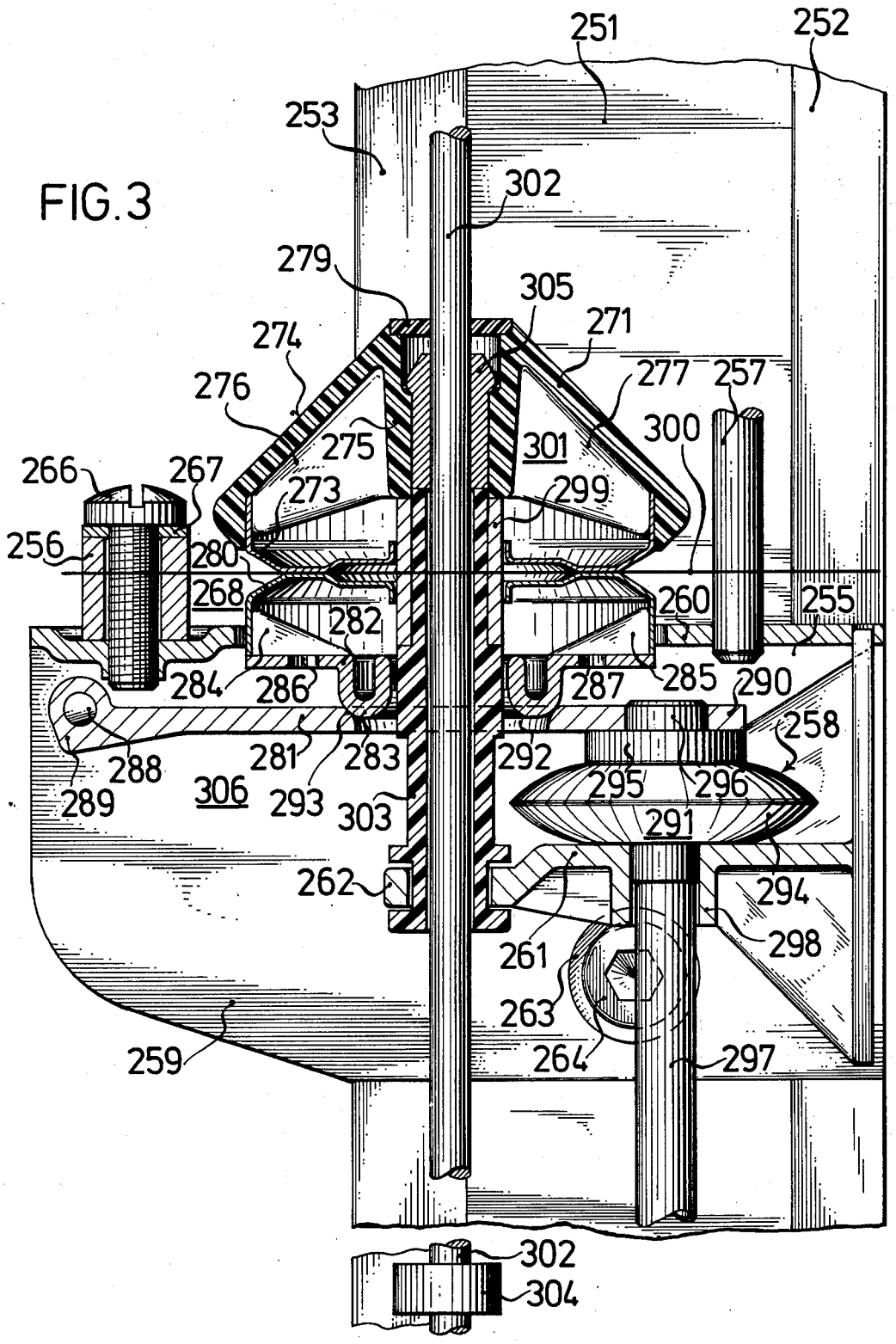
FIG. 3 is a longitudinal sectional view of a second embodiment of the invention.

In the second embodiment of the invention according to FIG. 3, all parts of the first embodiment have been used with the exception of the following parts: the central rotary drive 301 of the thread brake 306 shown in FIG. 3 is constructed differently from the first embodiment. Instead of a hollow shaft, a shaft 302 is provided in this case and is constructed as a drive shaft which extends through several brake disc pairs 268 of thread brakes arranged above one another for holding and driving the brake disc pairs 268, and is supported, in part, outside of the thread brakes in separate shaft bearings 303, 304. To effect a connection of the shaft 302 with the upper brake disc 273 which is fixed against torsion, a pressure ring 305 is inserted between the shaft 302 and the central sleeve 275 of the disc holder 271.

One of the hereinaforementioned shaft bearings, namely the shaft bearing 303, is formed of a sleeve of plastic material which extends into the pair of brake discs 269 from below, and is surrounded at the level of the pair of brake discs 268 by a sleeve 299 of wear-resistant plastic material. The expansion member 294 of the loading device 258 and the shaft bearing 303 have a common beam 261 in the embodiment of FIG. 3.

In contrast with the previous embodiment, only the shaft 302 and the disc holder 271 with the parts clamped thereto rotate in the embodiment of FIG. 3. The sleeve 299 of wear-resistant material, in this case, also assumes the function of a rope friction body which, however, is stationary like the other rope friction bodies. Otherwise, this embodiment of FIG. 3 does not differ technically or operationally from the previous embodiment of FIG. 1.

Figure 4:
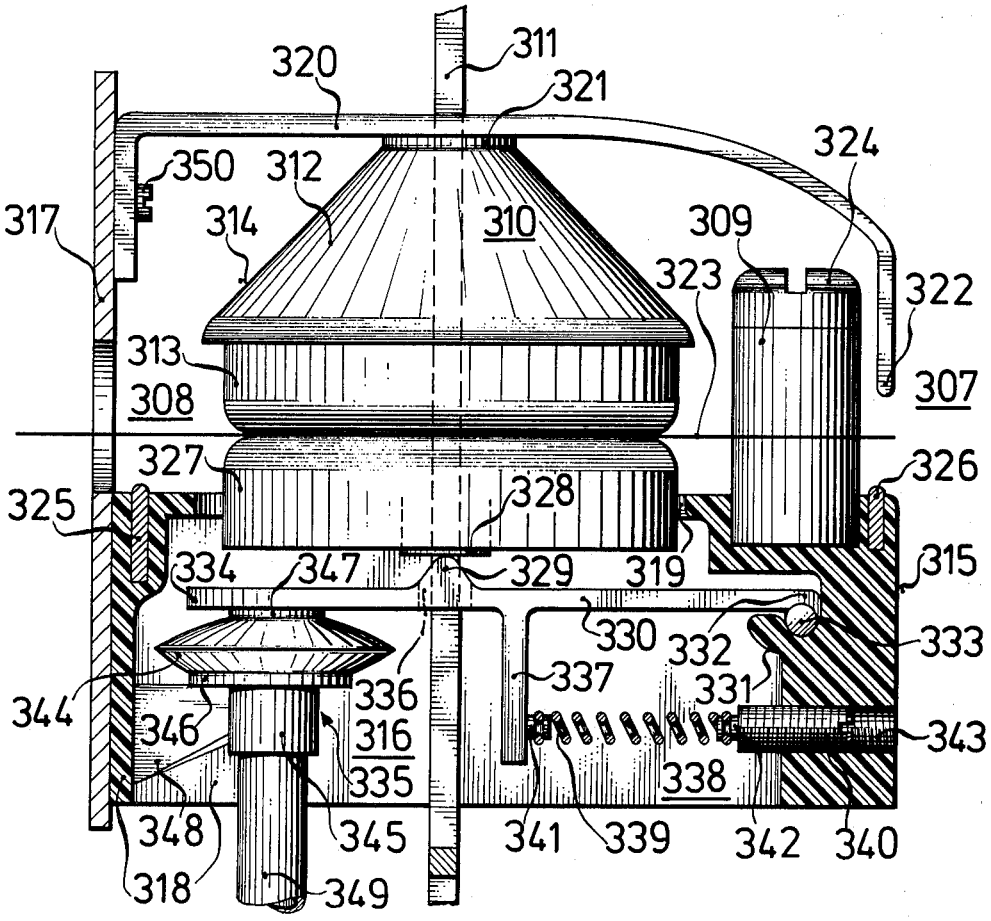
FIG. 4 is a side elevational view, partly in section, of a third embodiment of the invention.

A third embodiment is shown highly simplified in FIG. 4. The thread brake 307 according to FIG. 4 has a pair of brake discs 308 and a separate rope friction body 309. In addition, a central rotary drive 310 is provided, which is formed of a continuous shaft 311 of square cross section and a disc holder 312 for the upper brake disc 313. The disc holder 312 of FIG. 4 also has the form of a hood with a smooth external surface 314. Entrainment of the disc holder 312 is effected by a central opening with a square cross section located in the disc holder 312.

The thread brake 307 has a common holding device 315 for the rope friction body 309 and for an adjustable pneumatic loading device 316. The holding device 315 has a support body 318, open at the bottom thereof, and formed of injection-molded plastic material with a large opening 319 for receiving without contact, the brake disc pair 308 therein. The support body 318 is fastened to a rear wall 317 of metal, to which also a yoke 320 is attached by means of a screw 350. The disc holder 312 of the upper brake disc 313 makes contact with the yoke 320 from below through the intermediary of a washer 321. A downwardly drawn end 322 of the yoke 320 serves as a guiding edge for the thread 323.

The sleeve-shaped rope friction body 309 of wear-resistant material is held by means of a screw 324 in a cutout of the support body 318. In addition, two protective tracks 325, 326 are visible in the sectional view of FIG. 4 which are received in corresponding slots formed in the support body 318 and serve as protection against wear.

The pair of brake discs 308 is held by the central vertical shaft 311 of the rotary drive 310 and is secured against lateral shifting or yielding. The lower brake disc 327 of the brake disc pair 308 rests, through the intermediary of a bridge 328, on a saddle 329 of a support element 330 of the loading device 316.

The holding device 315 has a support location 331 in the form of a channel in which a rod 333 is fastened to one end 332 of the lever-like loading element 330 is supported. The other end 334 of the loading element 330 is in contact with a pneumatic pressure device 335. The saddle 329 of the loading element 330 has a cutout 336 formed therein for passage of the shaft 311 therethrough.

The loading element 330 is connected to a preloading device 338 by an arm 337. The preloading device 338 has a coil or helical spring 339 and an adjusting screw or setscrew 340 for changing the spring pretension.

Connection of the coil spring 339 with the arm 337 is established by a spring-mounting member 341 located at the arm. The setscrew 340 also has, at the end thereof, a spring-receiving extension 342. FIG. 4 shows that the setscrew 340 is accommodated in a threaded bore 343 formed in the support body 318, and that the spring pretension can be adjusted by turning the setscrew 340 by means of a screw driver.

The penumatic pressure device 335 has a thin-walled expansion body 344 acted upon by compressed gas. The expansion body 344 is formed of a bellow-shaped diaphragm or membrane of rubber-elastic material. The inlet of the expansion body 344 is constructed as a pipe stub 345. Above the pipe stub 345, there is located a support plate 346 for the expansion body 344. Above the expansion body 344, a plate 347 is disposed at the end 334 of the loading element 330 for ensuring better force transmission. The pipe stub 345 is connected to the support body 318 by a cross piece 348. From the pipe stub 345, a hose 349 extends to a non-illustrated compressed-gas line, the internal pressure of which can be controlled centrally.

In this embodiment of the invention, the axial forces of the brake disc pair 308 are absorbed by the yoke 320. The non-illustrated shaft bearings of the shaft 311 of FIG. 4, therefore, need not take up any axial forces. By presetting the brake disc loading, in all thread brakes of the creel, identical braking behavior can be set, if desired. A different braking behavior can be set progressively, however, for example, from one creel beam to another. This is necessary if all threads of the thread bunch leaving the creel are to have the same thread tension.

I claim:

1. Thread brake for creels having at least one pair of braking discs with a central rotary drive and at least one separate rope friction body, comprising an adjustable loading device having a loading element, a common holding device for the rope friction body and for said adjustable loading device, the rotary drive having a central vertical shaft holding the pair of braking discs including an upper braking disc comprising a braking disc member and a disc holder secured thereto, sid disc holder being formed of plastic material and connected to the shaft so as to be fixed against rotation relative thereto and a lower braking disc resting on said loading element of said loading device.

2. Thread brake according to claim 1 wherein said braking disc member has a rim, and said disc holder of said upper braking disc is in the form of a hood with a smooth external surface extending over said rim of said braking disc member.

3. Thread brake according to claim 1 wherein said holding device has a vertical rear wall, and including a yoke fastened to said vertical rear wall, said disc holder of said upper braking disc engaging said yoke from below.

4. Thread brake according to claim 1 wherein said loading device has a lever-like loading element and wherein said holding device has a supporting location at which one end of said lever-like loading element is supported, said loading element having another end in contact with a pneumatic pressure device; said loading element being formed with a cutout through which said central vertical shaft extends and said loading element being in contact, in vicinity of said cutout, with said lower brake disc.

5. Thread brake according to claim 4 wherein said loading element is connected to a preloading device.

6. Thread brake according to claim 5 wherein said preloading device has a coil spring and an adjusting screw engaging therewith for changing the spring tension thereof.

7. Thread brake according to claim 4 wherein said pneumatic pressure device comprises a thin-walled expansion body acted upon by compressed gas.

8. Thread brake according to claim 7 wherein said expansion body comprises a bellow-like diaphragm formed of rubber-elastic material.

9. Thread brake according to claim 7 wherein said central vertical shaft is hollow and is supported in a hollow shaft bearing, said hollow shaft bearing and said expansion body of said loading device having a common support.

10. Thread brake according to claim 1 wherein said central vertical shaft is a drive shaft extending through a plurality of braking disc pairs disposed above one another in holding and driving engagement therewith, said drive shaft being supported in part outside the braking disc pairs in separate shaft bearings.

11. Thread brake according to claim 10 wherein one of said shaft bearings comprises a sleeve extending into the pair of braking discs from below and surrounded at the level of the braking disc pair by a sleeve of wear-resistant material.

12. Thread brake according to claim 11 wherein said loading device includes a pneumatic pressure device comprising a thin-walled expansion body acted upon by compressed gas, said expansion body of said loading device and said one shaft bearing having a common support.

13. Thread brake according to claim 1 wherein said central vertical shaft is a hollow shaft and is supported in a separate hollow shaft bearing.

14. Thread brake according to claim 13 including a sleeve of wear-resistant material surrounding said hollow shaft at the level of the pair of brake discs.

15. Thread brake according to claim 13 wherein a common rotatable drive shaft extends through respective hollow shafts of a plurality of said braking disc pairs disposed above one another, and is connected to the respective hollow shafts so as to be fixed against rotation relative thereto.

16. Thread brake according to claim 15, wherein said disc holder of said upper brake disc has a central sleeve, and including a pressure ring inserted between said drive shaft and said central sleeve.

17. Thread brake according to claim 1 wherein said holding device is fastened to a beam of a creel, said creel beam being L-shaped and having two mutually perpendicular support legs, both engaged by said holding device.

18. Thread brake according to claim 17 wherein said creel beam is formed of angled-off sheet metal having lateral edges which are flanged-over outwardly.

19. Thread brake according to claim 18 including a clamp connecting said holding device to said creel beam, said clamp being secured to said holding device and extending beyond one of the lateral edges of said sheet metal creel beam.

20. Thread brake according to claim 1 wherein said lower brake disc also comprises a brake disc member and a disc holder secured thereto.

* * * * *